US005860173A

United States Patent [19]

Herring

[11] Patent Number: 5,860,173

[45] Date of Patent: Jan. 19, 1999

[54] BUBBLE BATH DISPENSER

[76] Inventor: Gregory L. Herring, P.O. Box 15773, Colorado Springs, Colo. 80935

[21] Appl. No.: 762,347

[22] Filed: Dec. 9, 1996

[51] Int. Cl.[6] ..... A47K 5/12; A47K 5/14

[52] U.S. Cl. ..... 4/661; 4/295; 4/294; 239/316; 446/15; 446/153

[58] Field of Search ..... 4/661, 559, 227.1, 4/287, 293, 294, 295, 309, 222, 222.1; 220/367.1; 239/314, 316; 446/15, 153

[56] References Cited

U.S. PATENT DOCUMENTS

| | | | |
|---|---|---|---|
| 699,982 | 5/1902 | Seabury et al. | 4/294 |
| 1,290,736 | 1/1919 | Greenberg | 4/295 |
| 1,880,962 | 10/1932 | Koppelman | 4/309 |
| 1,904,157 | 4/1933 | Martin | 239/316 |
| 2,020,864 | 11/1935 | Aronson et al. | 4/227.1 |
| 2,032,192 | 2/1936 | Wheeler, Jr. | 446/15 |
| 3,810,464 | 5/1974 | Sheeler | 4/559 |
| 4,128,905 | 12/1978 | Mathes | 4/287 |
| 4,752,035 | 6/1988 | Felder | 4/287 |
| 4,773,103 | 9/1988 | Dahlheimer | 4/227.1 |

*Primary Examiner*—Henry J. Recla
*Assistant Examiner*—Charles R. Eloshway
*Attorney, Agent, or Firm*—G. F. Gallinger

[57] ABSTRACT

A metering dispenser for bubble bath which may be optimally positioned and anchored within a drain of a bath tub is disclosed. The bubble bath dispenser comprising: a container body having a bottom portion having a bottom sidewall and adapted to closely seat within and across the bath tub drain; a central portion adapted to peripherally surround the drain and sealingly seat on the interior bottom side portion of the bath tub; a top wall portion extending upwardly above and around the central portion; and, a cover adapted to seat on the top wall portion of the container body. In the preferred embodiment the dispenser has an overall disk shape and a layered appearance decorated with light markings giving it an unidentified flying object appearance which appeals to young children.

12 Claims, 1 Drawing Sheet

BUBBLE BATH DISPENSER

FIELD OF INVENTION

This invention relates to metering dispensers for bubble baths. More particularly this invention relates to such dispensers which have a means for optimal positioning and anchoring within a bath tub and which have a decorative/toy shaped body to appeal to young children.

BACKGROUND OF THE INVENTION

Young children particularly enjoy a bubble bath. They enjoy hiding in and playing with the foam. One method of dispensing the bubble bath soap is to measure it in a cup and pour it into the bath tub. A problem with this approach is that the soap is not maintained in the optimal position beneath the faucet to maximize foaming. Even if the soap is initially positioned beneath the faucet the discharge of water immediately washes it away.

OBJECTS AND STATEMENT OF INVENTION

It is an object of this invention to disclose a metering dispenser for bubble bath which has adequate means for anchoring it in an optimal position within the bath tub beneath the discharging faucet. It is an object of this invention to disclose a dispenser which will maintain either a liquid or crystal bubble bath soap in the optimum position beneath the discharging faucet so that it may produce a maximum amount of foam. It is yet a further object of this invention to disclose a dispenser which is convenient to fill and which is easy to position and adequately anchor in the optimal position. It is yet a further object of this invention to disclose a bubble bath dispenser which has both a functionally shaped body and a body shaped to appeal to the imagination of young children. It is a final object of this invention to disclose a bubble bath dispenser which is exceptionally attractive and which is inexpensive to manufacture.

One aspect of this invention provides for a bubble bath dispenser for use in a drain of a bath tub comprising: a container body having a bottom portion having a bottom sidewall and adapted to closely seat within and across the bath tub drain; a central portion adapted to peripherally surround the drain and sealingly seat on the interior bottom side portion of the bath tub; a top wall portion extending upwardly above and around the central portion; and, a cover adapted to seat on the top wall portion of the container body.

A preferred aspect of this invention provides for a dispenser as above having an overall disk shape and a layered appearance decorated with light markings to look like an unidentified flying object.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
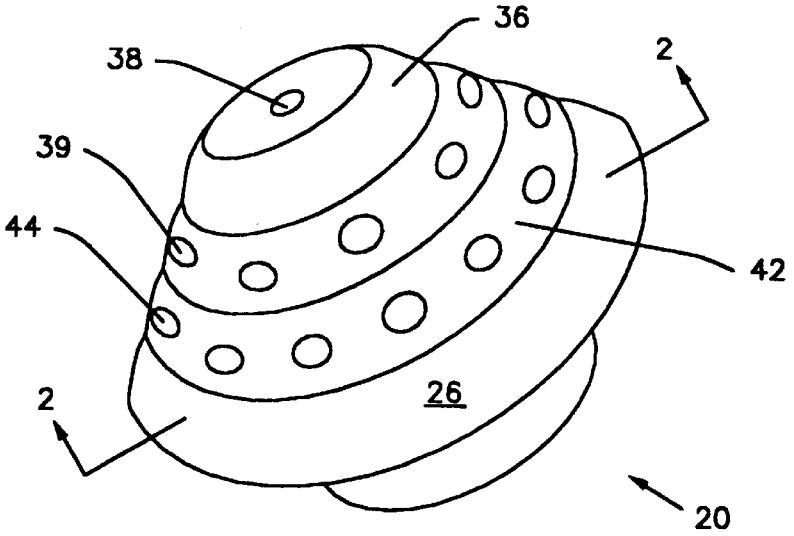
FIG. 1 is a perspective view of a bubble bath dispenser having its cover in a closed position.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
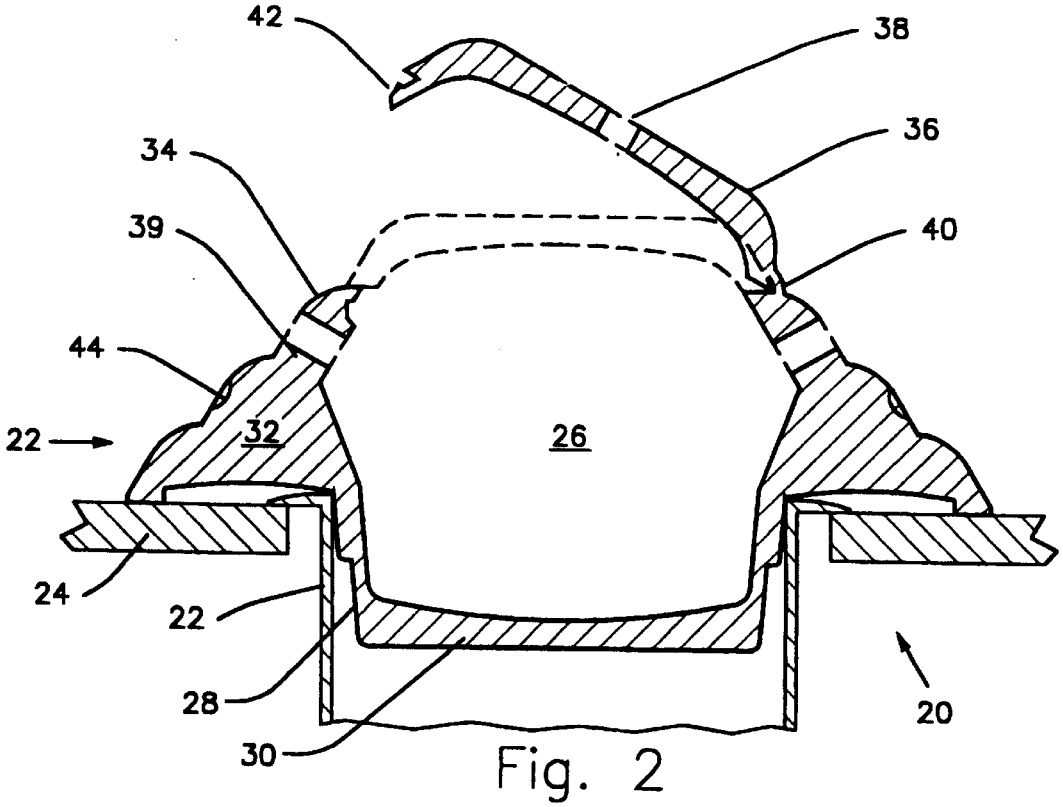
FIG. 2 is an enlarged cross sectional view taken along line 2—2 of the bubble bath dispenser shown in FIG. 1, positioned in the drain of a bathtub and having its cover in an open position.

Turning now to the drawings and more particularly to FIG. 1 we have a perspective view of a bubble bath dispenser 20 having its cover 36 in a closed position. FIG. 2 is an enlarged cross sectional view taken along line 2—2 of the bubble bath dispenser 20 shown in FIG. 1, positioned in the drain 22 of a bathtub 24 and having its cover 36 in an open position. The bubble bath dispenser 20 is used in a drain 22 of a bath tub 24. It comprises: a container body 26 having a bottom portion 28 having a bottom sidewall 30 which is adapted to closely seat within and across the bath tub drain 22; a central portion 32 adapted to peripherally surround the drain 22 and sealingly seat on the interior bottom side portion of the bath tub 24; a top wall portion 34 extending upwardly above and around the central portion 32; and, a cover 36 adapted to seat on the top wall portion 34 of the container body 26.

In the preferred embodiment the dispenser 20 has a circular opening 38 through its cover 36, and spaced openings 39 around its top wall portion 34. Most preferably the bubble bath dispenser 20 is integrally moulded from soft plastic. The cover 36 is hinged 40 to the top wall portion 34 with flexible plastic. A latch 42 holds the cover 36 in a closed position.

Preferably the top wall portion 34 slopes upwardly and inwardly and the openings 39 therearound slope inwardly and downwardly. The dispenser 20 has an overall disk shape. It has lateral layers 42, one of which has spaced openings 39 therearound. In the most preferred embodiment one layer 42 has spaced markings 44 therearound to represent lights on an unidentified flying object (U.F.O.)

The foregoing description of the invention has been described with preferred specific embodiments thereof. This description is intended to illustrate, and not to limit the scope of the invention. It will be evident that there are a number of changes, adaptions and modifications of the present invention which come to mind and are within the province of the skilled in the art. It is intended that all such variations not departing from the spirit of the invention be considered as within the scope thereof as limited solely by the claims appended hereto.

I claim:

1. A bubble bath dispenser for use in a drain of a bath tub comprising:

a container body having an interior adapted to contain a bubble-producing soap and a bottom portion having a non-perforated bottom sidewall adapted to closely seat within and across the bath tub drain;

a central portion adapted to peripherally surround the drain and sealingly seat on the bottom portion of the bath tub to prevent water in the bath tub from entering the drain;

a top wall portion extending upwardly above and around the central portion; and, a cover adapted to seat on the top wall portion of the container body and selectively provide access to the interior of the container.

2. A dispenser as in claim 1 having an opening through the top wall portion.

3. A dispenser as in claim 2 having spaced openings around the top wall portion.

4. A dispenser as in claim 3 wherein the openings are circular.

5. A dispenser as in claim 2 having an opening in the cover.

6. A dispenser as in claim 5 wherein the bubble bath dispenser is moulded from soft plastic.

7. A dispenser as in claim 5 wherein the cover is hinged to the top wall portion with flexible plastic.

8. A dispenser as in claim 7 wherein the dispenser further comprises a latch to hold the cover in a closed position.

9. A dispenser as in claim 5 wherein the dispenser has a top wall portion which slopes upwardly and inwardly and wherein the openings therearound slope inwardly and downwardly.

10. A dispenser as in claim 9 wherein said dispenser has an overall disk shape.

11. A dispenser as in claim 10 wherein said dispenser has lateral layers, one of said layers having spaced openings therearound.

12. A dispenser as in claim 11 wherein one layer has spaced decorative openings therearound.

* * * * *